US011988094B2

(12) United States Patent
McLaren

(10) Patent No.: US 11,988,094 B2
(45) Date of Patent: May 21, 2024

(54) DRILLING ASSEMBLY FOR INSERTING A ROCK BOLT

(71) Applicant: HARDROCK MINING SOLUTIONS PTY LTD, Western Australia (AU)

(72) Inventor: Clarissa Elizabeth McLaren, Western Australia (AU)

( * ) Notice: Subject to any disclaimer, the term of this patent is extended or adjusted under 35 U.S.C. 154(b) by 0 days.

(21) Appl. No.: 17/759,191

(22) PCT Filed: Jan. 28, 2021

(86) PCT No.: PCT/AU2021/050051

§ 371 (c)(1),
(2) Date: Jul. 21, 2022

(87) PCT Pub. No.: WO2021/151150

PCT Pub. Date: Aug. 5, 2021

(65) Prior Publication Data

US 2023/0074816 A1 Mar. 9, 2023

(30) Foreign Application Priority Data

Jan. 29, 2020 (AU) ..... 2020900236

(51) Int. Cl.

| | |
|---|---|
| ***E21D 21/00*** | (2006.01) |
| ***E21B 10/42*** | (2006.01) |
| ***E21B 17/042*** | (2006.01) |
| ***E21B 17/046*** | (2006.01) |

(52) U.S. Cl.

CPC ..... *E21D 21/004* (2013.01); *E21B 10/42* (2013.01); *E21B 17/042* (2013.01); *E21B 17/046* (2013.01); *E21D 21/0033* (2013.01)

(58) Field of Classification Search

CPC ..... E21D 21/004; E21D 21/0033; E21D 21/0053; E21B 10/42; E21B 17/042; E21B 17/046; E21B 10/00

See application file for complete search history.

(56) References Cited

U.S. PATENT DOCUMENTS 1,642,183 A 9/1927 Thurston
8,087,850 B2 * 1/2012 Craig ..... E21D 21/008 405/259.4

(Continued)

FOREIGN PATENT DOCUMENTS

WO 84/02375 A1 6/1984

OTHER PUBLICATIONS

ISR; Australian Patent Office; Mar. 16, 2021.

*Primary Examiner* — Jonathan Malikasim
(74) *Attorney, Agent, or Firm* — Patshegen IP; Moshe Pinchas

(57) ABSTRACT

A drilling assembly is disclosed for drilling a borehole in a rock body and inserting a rock bolt within the borehole in a single pass. The drilling assembly includes an elongated drill string having a downhole end. A drill bit is detachably joined to the downhole end of the drill string, with the drill bit having an external screw thread extending in an axial direction of the drill string. The drill string is surrounded by a rock bolt sleeve that has a thread engaging formation at or near its downhole end and that is arranged to cooperate with the external screw thread of the drill bit so that the drill bit is able to be screwed into the rock bolt sleeve.

22 Claims, 5 Drawing Sheets

(56) References Cited

U.S. PATENT DOCUMENTS

| | | | | |
|---|---|---|---|---|
| 8,721,227 | B2 * | 5/2014 | Oldsen | E21D 21/0033 405/259.4 |
| 11,066,931 | B2 * | 7/2021 | Thomas | E21D 21/0046 |
| 11,073,018 | B1 * | 7/2021 | Knox | E21D 21/004 |
| 2007/0274788 | A1 * | 11/2007 | Ravat | E21B 10/64 175/258 |
| 2010/0098500 | A1 | 4/2010 | Weaver et al. | |
| 2012/0128444 | A1 | 5/2012 | Podesser et al. | |
| 2018/0003057 | A1 | 1/2018 | McLaren | |
| 2018/0087381 | A1 * | 3/2018 | Ferland | E21D 20/02 |
| 2023/0258086 | A1 * | 8/2023 | Pastorino | E21D 21/0053 405/259.1 |

* cited by examiner

DRILLING ASSEMBLY FOR INSERTING A ROCK BOLT

TECHNICAL FIELD

The present disclosure relates to a drilling assembly for inserting a rock bolt.

More particularly, the present disclosure relates to a drilling assembly for inserting a rock bolt in a rock body in a single pass, whereby the rock bolt functions as a friction bolt having a point anchor at its downhole end.

BACKGROUND

Rock bolts, also known as anchor bolts or friction bolts, are used in the mining industry to support and stabilise a rock body against creep movement or collapse. The rock bolts are fixed in the rock body and then used to locate bearing plates or thrust plates to apply a compression force onto the rock strata to stabilise the rock body. It is also known to use the rock bolts to support a wire mesh adjacent the rock face and to spray a settable concrete over the mesh to strengthen the rock face.

Many types of rock bolts are known and they are generally in the form of an elongated element such as a tube, cable, rod or combinations thereof that are able to be fitted into a borehole drilled into the rock body and subsequently secured within the borehole. Rock bolts are typically secured in the borehole by chemical or mechanical means. Chemical fixations utilise an epoxy or cement to bond the anchor bolt within the hole, while mechanical fixations normally utilise friction force to jam the rock bolt in place.

One type of mechanically fixed rock bolt is an anchor bolt, which includes an elongated element with a point anchor provided at the downhole end thereof, whereby the point anchor is jammed against the rock body. The strength of the anchor bolt is dependent on the inherent strength of the material of which the elongated element is made. Sometimes anchor bolts are provided in the form of a split sleeve into which a plunger is pulled or forced so that the plunger causes the sleeve to expand and press against the sides of the rock body in the borehole forming the point anchor.

Another type of mechanically fixed rock bolt is a friction bolt. These have a generally cylindrical body of greater outer diameter than the borehole into which they are to be inserted. When they are driven into the borehole, the friction bolt resiliently deforms to exert radial and frictional forces against the rock body. Such friction bolts rely heavily on the effective length that they are embedded into the rock body and also on the competency of the rock body, i.e. incompetent rock is not able to frictionally retain a friction bolt. For example, if a 2.4 m long friction bolt designed to provide 4 ton/m support is fully installed in a rock body but 1 m of its length extends through incompetent rock then the effective bolt strength is only about 5.6 ton instead of the expected about 9.6 ton.

Rock bolts are conventionally installed in a two-step process, whereby a borehole is initially drilled in the rock body using a drilling tool and subsequently the desired type of rock bolt is inserted and secured within the borehole. This conventional process can be time consuming.

Alternative installation methods have been developed for friction bolts whereby the friction bolt is installed in a one-step process with the friction bolt being inserted while the borehole is being drilled. This is achieved by extending a drill string through the friction bolt sleeve, i.e. the diameter of the drill string is smaller than that of the sleeve, and detachably providing a larger diameter drill bit on the drill string. Once the borehole is drilled and the friction bolt installed, the drill bit is detached to allow retrieval and reuse of the drill string. This inevitably results in the loss of the drill bit which remains in the borehole. A further improvement thereon, as disclosed in PCT/AU2016/050257, is to provide a two-part drill bit having a central drill bit shank on which is mounted an outer annular drill bit collar—in use only the drill bit collar is left in the borehole while the drill bit shank is able to be retrieved together with the drill string.

In the above one-step processes, the friction bolt operates in its conventional manner and the detachable drill bit, or drill bit collar, is simply "discarded" in the borehole.

It is to be understood that, if any prior art publication is referred to herein, such reference does not constitute an admission that the publication forms a part of the common general knowledge in the art, in Australia or any other country.

SUMMARY OF THE DISCLOSURE

According to a first aspect of the disclosure, there is provided a drilling assembly for drilling a borehole in a rock body and inserting a rock bolt within the borehole in a single pass, the drilling assembly comprising:

- an elongated drill string having a downhole end;
- a drill bit arranged to be detachably joined to the downhole end of the drill string, the drill bit having an external screw thread extending in an axial direction of the drill string; and
- a rock bolt sleeve at least partially surrounding the drill string, the sleeve having a thread engaging formation at or near its downhole end arranged to cooperate with the external screw thread of the drill bit.

The drill bit may be detachably joined to the drill string by a spigot and socket connection, whereby the spigot is removably received within the socket. In one embodiment the spigot extends from the downhole end of the drill string and is aligned along the drill strings' central axis, while the socket is defined within the drill bit. In another embodiment the spigot extends from the drill bit, while the socket is defined in the downhole end of the drill string and is aligned along drill strings' central axis.

The spigot may have an outer surface defining one or more grooves extending along the spigot with the socket having an inner surface defining one or more ridges being complementary to the grooves, whereby the ridges are received within the grooves when the drill bit is joined to the drill string. The grooves may extend spirally around and along the spigot to define a helix, a double helix, a triple helix or a quadruple helix. The grooves and ridges may extend at an angle of 5°-20° relative to the drill strings' central axis. The grooves and the external screw thread may spiral in the same direction.

The drill bit may be substantially frustoconical having a tapered side wall. The drill bit may be cylindrical along a part of its length extending from its downhole end to the tapered side wall. The external screw thread may extend along the length of the tapered side wall.

The sleeve may be substantially tubular having an axial slot extending along its length so that the sleeve is substantially C-shaped in end view.

In one embodiment the thread engaging formation includes a downhole edge of the sleeve. In one embodiment the thread engaging formation includes one or more bent off flanges extending radially inwardly from the sleeve. In another embodiment the thread engaging formation is an internal screw thread integrally formed within the sleeve. In another embodiment the thread engaging formation is an internal screw thread defined within a nut that is fixedly attached within the sleeve.

The internal screw thread may taper inwardly from the downhole end of the sleeve. The internal screw thread may taper at an angle of 1°-10° relative to the sleeve's central axis.

According to a second aspect of the disclosure, there is provided a method of drilling a borehole and inserting a rock bolt within the borehole in a single pass, the method comprising the steps of:

providing a drill string having a detachable drill bit joined to its downhole end, the drill bit having an external screw thread extending in an axial direction of the drill string;

locating a rock bolt sleeve around the drill string so that the sleeve is spaced away from the drill bit, the rock bolt sleeve having a thread engaging formation at or near its downhole end;

with the drill string rotating in a first direction, drilling the borehole until the sleeve has been inserted into the borehole to a desired length so that the sleeve is frictionally engaged and held within the rock body;

while continuing rotation of the drill string in the first direction, withdrawing the drill string from the borehole with the drill bit remaining attached to the drill string so that the drill bit enters into the downhole end of the sleeve allowing the external screw thread on the drill bit to engage the thread engaging formation of the sleeve, and subsequently screwing the drill bit into the sleeve until the drill bit and sleeve become wedged against the rock body; and stopping or reversing the direction of rotation of the drill string to permit the drill bit to be detached from the drill string and subsequently fully retracting the drill string from the sleeve.

The method may be performed using a drilling assembly according to the first aspect of the disclosure.

According to a third aspect of the disclosure, there is provided a drill bit for use in a drilling assembly for drilling a borehole in a rock body and inserting a rock bolt within the borehole in a single pass, the drill bit comprising:

a drill bit body arranged to be detachably joined to the downhole end of a drill string, the drill bit having an external screw thread extending in an axial direction of the drill string, wherein the external screw thread is configured to cooperate with a thread engaging formation provided at or near a downhole end of a rock bolt sleeve so that the drill bit is able to be screwed into the rock bolt sleeve.

The drill bit body may be substantially frustoconical having a conically tapered side wall. In one embodiment the drill bit body is cylindrical along a part of its length extending from its downhole end to the tapered side wall. The external screw thread may extend along the length of the tapered side wall.

BRIEF DESCRIPTION OF DRAWINGS

The above and other features will become more apparent from the following description and with reference to the accompanying schematic drawings. In the drawings, which are given for purpose of illustration only and are not intended to be in any way limiting.

DETAILED DESCRIPTION

Figure 1:
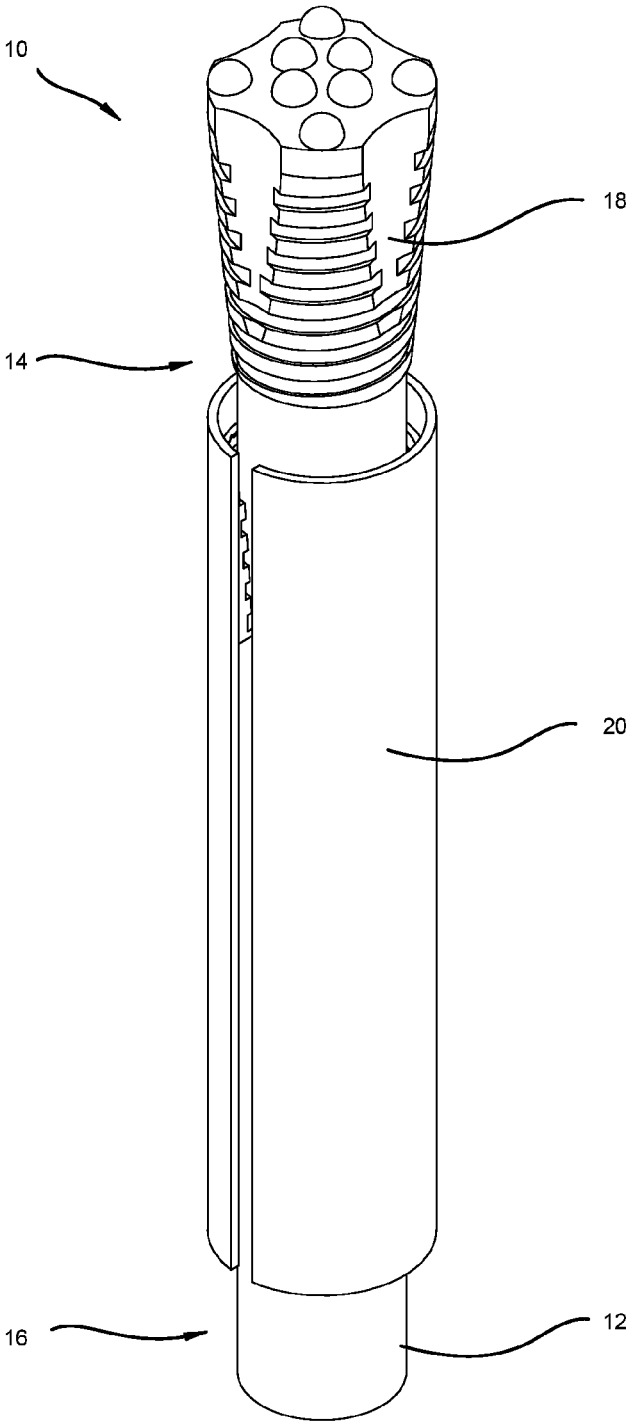
FIG. 1 is a top perspective view of a drilling assembly, shown in a pre-use configuration.

Referring to FIG. 1 of the drawings, there is shown a drilling assembly 10 for inserting a rock bolt in a rock body in a single pass, whereby the rock bolt functions as a friction bolt having a point anchor at its downhole end. The drilling assembly 10 includes an elongated drill string 12 having a downhole end 14 and an uphole end 16. A drill bit 18 is detachably joined to the drill string 12 at its downhole end 14. The drill string 12 extends through a rock bolt sleeve 20.

It should be understood for the purposes of the description that the terms "downhole" and "uphole" refer to operative drilling positions or rock bolt insertion positions relative to the borehole. Thus "downhole" is used herein to refer to a position deeper within the borehole, while "uphole" refers to a position closer to the opening of the borehole.

Figure 2:
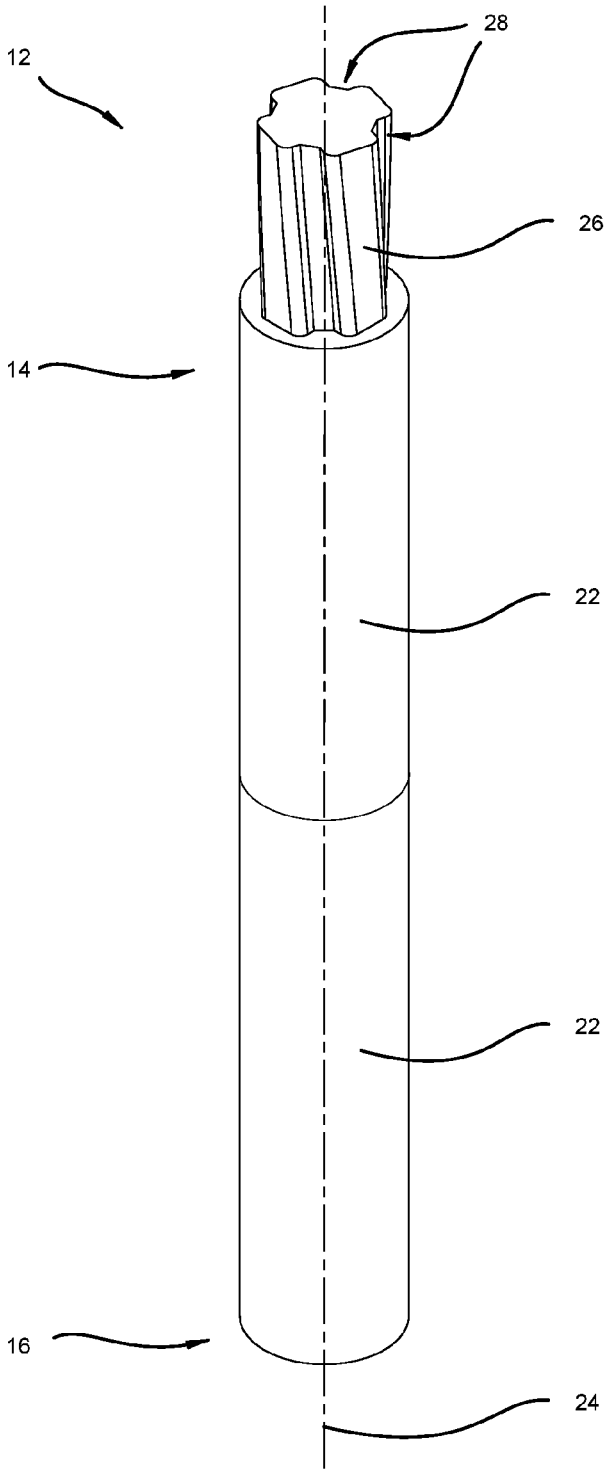
FIG. 2 is a top perspective view of a portion of a drill string used in the drilling assembly of FIG. 1.

As is shown more clearly in FIG. 2, the drill string 12 is a substantially elongated cylindrical body which comprises one or more drill rods 22 being joined end on end to achieve a desired length of the drill string. Although not shown in the drawing, the uphole end 16 of the drill string 12 is capable of being operatively joined to suitable drilling equipment for transferring torque to the drill string 12 to rotate the drill string around its central axis 24 in either a clockwise or anti-clockwise direction.

A spigot 26 extends axially from the downhole end 14 of the drill string 12. The spigot 26 has an outer surface defining one or more grooves 28 extending spirally around the spigot 26. In the exemplary embodiment the spigot 26 is shown with four grooves 28 being orthogonally arranged and spiralling in a left-hand quadruple helix around the spigot 26. In other embodiments the spigot 26 can have one groove 28 spiralling in a helix, two grooves 28 spiralling in a double helix or three grooves 28 spiralling in a triple helix. The spiral can be inclined at an angle of between 1° to 20° relative to the central axis 24, but in the exemplary embodiment is shown being inclined at an angle of about 5°.

Figure 3:
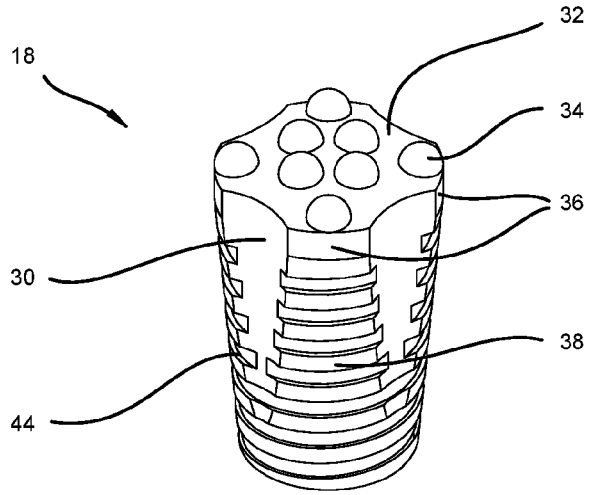
FIG. 3 is a top perspective view of a drill bit used in the drilling assembly of FIG. 1.
Figure 4:
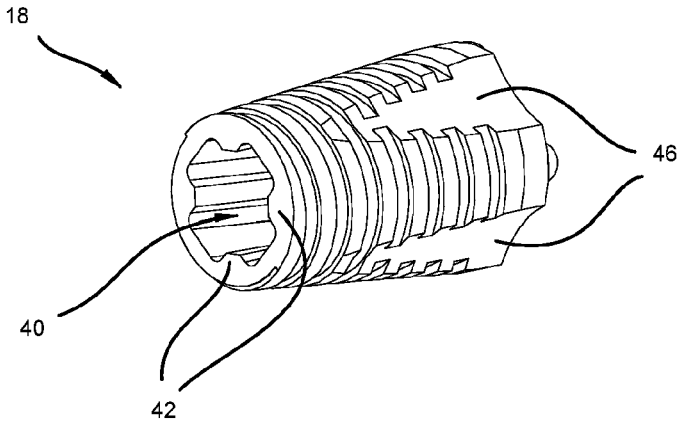
FIG. 4 is a bottom perspective view of the drill bit of FIG. 3.

Referring now to FIGS. 3 and 4, the drill bit 18 includes a substantially frustoconical bit body 30 that has a larger downhole end and a smaller uphole end. The bit body 30 has a transverse cutting wall 32 at its downhole end on which are mounted a number of drill studs 34, typically being made of tungsten carbide. The bit body 30 has a substantially cylindrical side wall 36 extending from the cutting wall 32 for a first part of its length which then leads into a narrowing conically tapered side wall 38 that extends to the uphole end of the bit body 30.

A socket 40 extends axially into the bit body 30 from its uphole end. The socket 40 is shaped complementary to the spigot 26 and is adapted to be detachably mounted thereon. In this regard the socket 40 has an inner surface defining one or more ridges 42 that are configured to be received within the grooves 28 when the drill bit 18 is mounted onto the spigot 26. Accordingly, the exemplary embodiment of the drill bit 18 has four ridges 42 being orthogonally arranged and spiralling in a left-hand quadruple helix around the socket 40 and at the same spiral angle as that of the grooves 28.

It will be appreciated that due to the spiral shape of the interlocking grooves 28 and ridges 42 that a purely linear separation force applied in a direction along the central axis 24 will not be able to detach the drill bit 18 from the drill string 12. To achieve such separation requires that also a rotational force be applied so that the ridges 42 can "screw" out of the grooves 28. Due to the shallow spiral angle, such unscrewing is quickly achieved within a fraction of a single rotation of the drill string 12 relative to the drill bit 18.

The drill bit 18 is further provided with an external screw thread 44 extending around the bit body 30. The external screw thread 44 extends from the uphole end of the bit body 30 along the conically tapered side wall 38 and up to the cylindrical side wall 36. In some embodiments the external screw thread 44 also can extend across the cylindrical side wall 36, but in the exemplary embodiment the external screw thread 44 terminates short of the cylindrical side wall 36. The external screw thread 44 spirals in the same direction as the ridges 42, i.e. being a left-hand screw thread in the exemplary embodiment.

A number of scalloped recesses 46 are formed in the bit body 30, which recesses 46 traverse an edge of the cutting wall 32 and which recesses extend to approximately midway along the length of the tapered side wall 38. The recesses 46 function, during use, to allow drill cuttings/dust to be exhausted from the interface of the cutting wall 32 and rock body so that the cuttings can flow in an uphole direction away from the cutting wall 32 and the drill bit 18.

Figure 5:
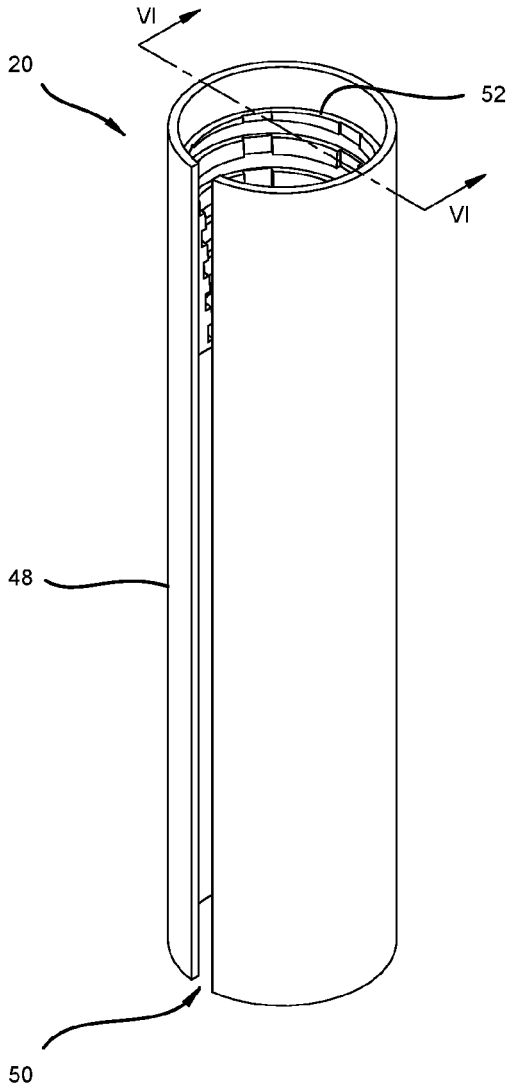
FIG. 5 is a top perspective view of a rock bolt sleeve used in the drilling assembly of FIG. 1.
Figure 6:
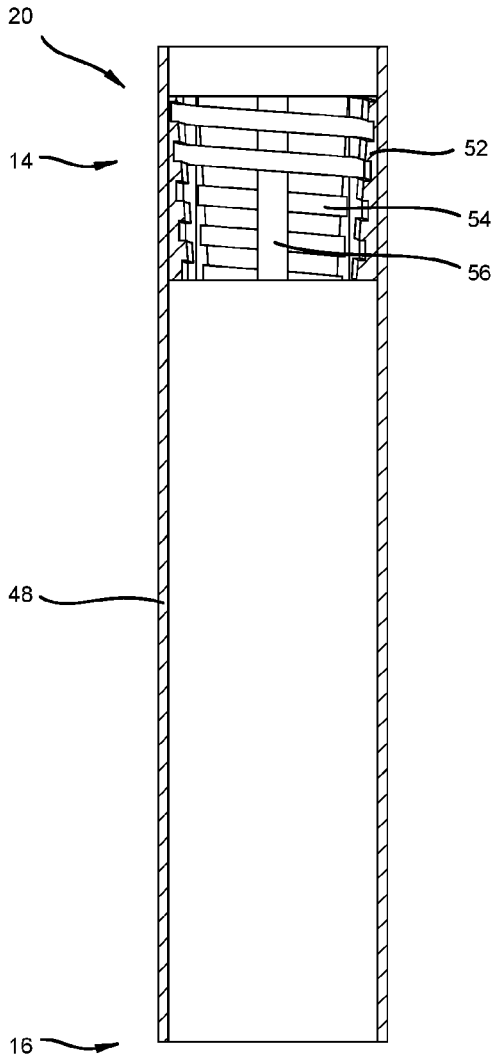
FIG. 6 is a sectional side view of the rock bolt sleeve seen along arrows VI-VI in FIG. 5.
Figure 7:
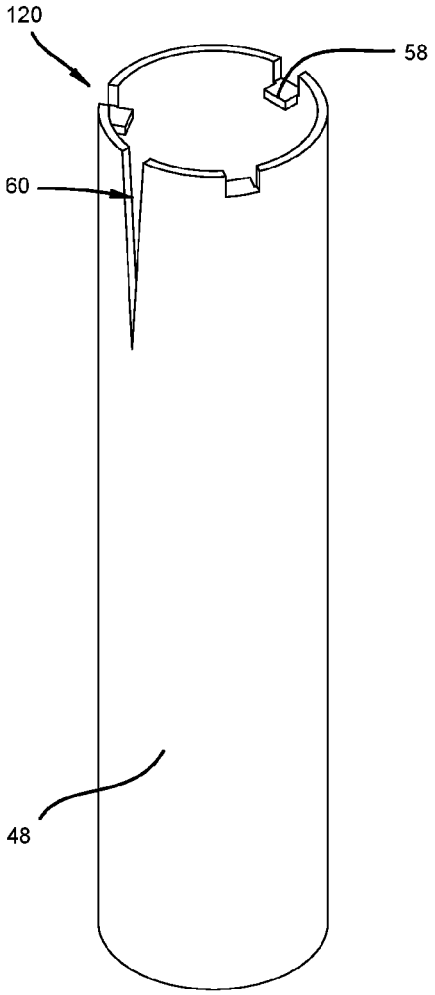
FIG. 7 is a perspective view of an alternative embodiment of the rock bolt sleeve.

The rock body sleeve 20 is illustrated more clearly in FIGS. 5 and 6. The sleeve 20 is a load bearing elongated member in the form of a hollow bar or tube 48 with an internal axial passage. In the present example, the tube 48 has a slot 50 extending along its axial length resulting in the tube 48 being substantially C-shaped in cross-section or end view. However, in other examples it is envisaged that the tube 48 can be fully closed in the form of a pipe that has an axial split or V-shaped cut-out 60 extending from its downhole end for a part of its length (see FIG. 7).

The tube 48 is typically made of metal, such as steel so that it has a suitably high tensile strength. It will be appreciated that the outer diameter of the tube 48, as well as the thickness of its side wall and its inherent resilience to compression, can be preselected so that the sleeve 20 is able to exert a desired outward pressure on the rock body surrounding the borehole into which it is to be inserted. In most cases this is achieved by having the outer diameter of the tube 48 (pre-installation) being slightly larger than the diameter of the borehole. Accordingly, when the tube 48 is inserted into the borehole, the tube 48 is circumferentially compressed and this results in the full or partial closure of the slot 50.

The uphole end 16 of the tube 48 can be joined to a bearing plate or other standard rock supporting equipment as is common and known in the art.

The sleeve 20 includes a thread engaging formation at or near its downhole end. In the exemplary embodiment the thread engaging formation is provided in the form of a split nut 52 located internally of the tube 48 and fixedly joined thereto, e.g. by welding. The nut 52 has an internal screw thread 54 being complementary to the external screw thread 44 provided on the drill bit 18. As can be most easily seen in FIG. 6, the nut 52 is spaced away from the downhole end 18 of the tube 48 by a distance being substantially equivalent to the length of the cylindrical side wall 36 of the drill bit 18. A number of axial channels 56 are cut into the internal screw thread 54, which channels 56 cooperate with the recesses 46 during use to allow drill cuttings/dust to be exhausted past the nut 52 in an uphole direction away from the cutting wall 32 and the drill bit 18. The exemplary embodiment of the nut 52 shown in FIGS. 5 and 6 comprises channels 56 being discretely spaced at radial intervals of about 60°.

The internal screw thread 54 tapers inwardly from the downhole end so that nut 52 has a larger downhole opening and a smaller uphole opening. The taper of the internal screw thread 54 can be inclined at an angle of between 1° to 20° relative to central axis 24, but in the exemplary embodiment is inclined at an angle of about 4°.

In an alternative embodiment there is shown a sleeve 120 (see FIG. 7), wherein the thread engaging formation comprises one or more bent off flanges 58 extending radially inwardly from the tube 48, e.g. being formed by inwardly bending parts of the downhole end of the tube 48, which flanges 58 are able to threadingly engage with the external screw thread 44. In yet a further embodiment, the thread engaging formation can be an internal screw thread integrally formed or cut directly into the inner face of the side wall of the tube 48—in such case the tube 48 may have a thickened side wall part near its downhole end 18.

Figure 8:
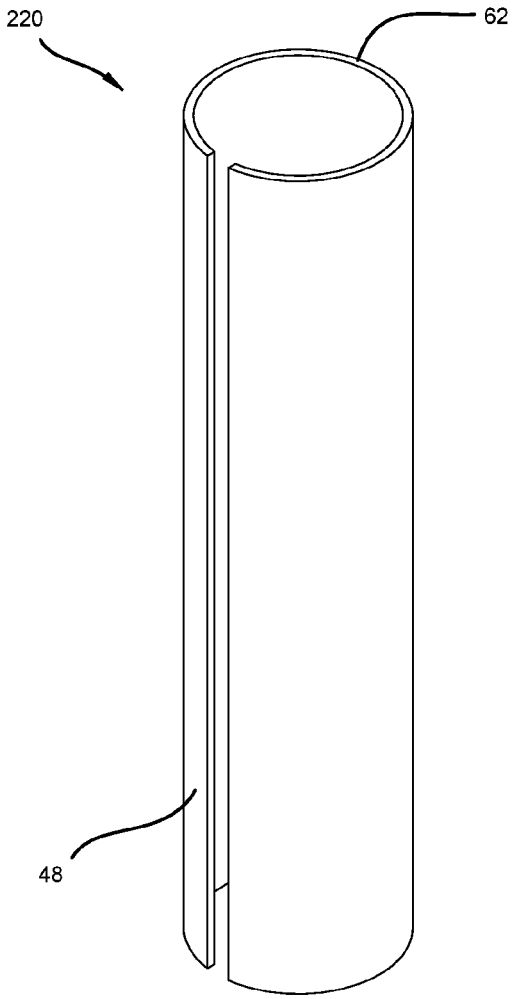
FIG. 8 is a top perspective view of a further alternative embodiment of the rock bolt sleeve.

In a further alternative embodiment (see FIG. 8) there is shown a sleeve 220, wherein a downhole edge 62 of the tube 48 functions as the thread engaging formation. In such case the edge 62 (or at least an inner corner thereof) can engage within the external screw thread 44. In yet a further embodiment, external screw thread 44 on the bit body 30 can be a self-tapping thread and the thread engaging formation in the tube 48 simply comprises a part of the tube 48, whereby during use the external screw thread 44 is able to cut a thread into the downhole end 14 of the tube 48—again, in such case the tube 48 may have a thickened side wall part near its downhole end 18. In one example, the external screw thread 44 has a thread angle of about 4°-5° with a thread pitch of about 14 tpi. In one example the bit body 30, or the external screw thread 44 can comprise a harder or denser material that the material of the tube 48.

In use, the drilling assembly 10 is assembled by passing the drill string 12 through the sleeve 20 and then attaching the downhole end of the drill string 12 to the drill bit 18 while attaching the uphole end of the drill string 12 to suitable drilling equipment. The length of the drill string 12 and/or sleeve 20 are selected so that the sleeve 20 is able to be spaced apart from the drill bit 18 during the drilling operation.

The impact drilling operation is then commenced by pressing the drill bit 18 against the rock face and drilling a borehole by imparting both rotational and percussion force to the drill string. With the exemplary embodiment of the drill string 12 and drill bit 18, both having the left-hand spiralling grooves 28 and ridges 42, the drill string will normally be operated using left-hand rotation (anti-clockwise). However, if drilling is to be performed using right-hand rotation, then use will need to be made of a drill string 12 and drill bit 18 having right-hand spiralling grooves 28 and ridges 42.

It will be appreciated that the nut 52 and/or flanges 58 assist in supporting and centralising the downhole part of the drill string 12 so that it remains centrally aligned within the sleeve 12. Further, in regard to the embodiment comprising the nut 52, the taper therein prevents the drill string 12 from contacting and potentially damaging the internal screw thread 54 during the drilling operation.

The sleeve 20 is thus hammered into the borehole at the same time that the borehole is being drilled with the sleeve 20 being compressed and frictionally held within the borehole. Although not shown in the exemplary embodiment, the drill string 12 can include an internal central conduit along which a flushing fluid can be pumped through the drill string and exhausted at the downhole end of the drill bit to flush away drill cuttings as the flushing fluid returns externally of the drill string to the uphole borehole opening.

After the sleeve 20 has been inserted into the borehole to a desired depth, and while continuing rotation of the drill string 12 in the drilling direction, the drill string 12 is slowly retracted from the borehole by pulling the drill string through the sleeve 20 so that the drill bit 18 enters into the downhole end of the sleeve 20 and the external screw thread 44 on the drill bit 18 engages the internal screw thread 54 or the flanges 58. It will be appreciated that the friction engagement between the rock body and the cylindrical side wall 36 prevents the drill bit 18 from becoming prematurely detached from the spigot 26.

Further rotation of the drill string 12 in the drilling direction causes the drill bit 18 to screw into the sleeve 20, while simultaneously the respective tapers of the tapered side wall 38 and the tapered internal screw thread 54 cooperate to outwardly deflect the downhole end of the sleeve 20. This process is continued until the drill bit 18 and sleeve 20 become wedged against the rock body preventing further outward deflection of the sleeve 20, i.e. at which time the drill bit 18 is jammed in place. In some instances this may occur after the drill bit 18 is located fully within the downhole end of the sleeve 20 and in other instances this may occur after the drill bit 18 only partially enters into the downhole end of the sleeve 20.

Thereafter the rotation of the drill string 12 is reversed, i.e. in the exemplary embodiment the drill string 12 is briefly rotated in a clockwise direction while still withdrawing the drill string 12 from the borehole, thereby causing the drill bit 18 to detach from the drill string, after which the drill string 12 is fully retracted from the sleeve 20.

The installed sleeve 20 is thus able to operate as a friction bolt having a point anchor at its downhole end and thereby is able to provide improved rock bearing support even if the sleeve 20 extends through incompetent rock for a part of its length.

It will be appreciated by persons skilled in the art that numerous variations and/or modifications may be made to the drilling assembly as shown in the specific embodiments without departing from the spirit or scope of the disclosure as broadly described. The present embodiments are, therefore, to be considered in all respects as illustrative and not restrictive.

For example, the provision of the spigot 26 and the socket 40 can be interchanged with the spigot 26 extending from the drill bit 18 and with the socket 40 being provided in the downhole end of the drill string 12.

In the claims which follow and in the preceding description, except where the context requires otherwise due to express language or necessary implication, the word "comprise" or variations such as "comprises" or "comprising" is used in a non-limiting and an inclusive sense, i.e. to specify the presence of the stated features but not to preclude the presence or addition of further features in the various embodiments of the drive sub. A reference to an element by the indefinite article "a" does not exclude the possibility that more than one of the elements is present, unless the context clearly requires that there be one and only one of the elements.

REFERENCE NUMERALS

10 drilling assembly
12 drill string
14 downhole end
16 uphole end
18 drill bit
20, 120, 220 sleeve
22 drill rods
24 central axis
26 spigot
28 grooves
30 bit body
32 cutting wall
34 studs
36 cylindrical side wall
38 tapered side wall
40 socket
42 ridges
44 external screw thread
46 recesses
48 tube
50 slot
52 nut
54 internal screw thread
56 axial channels
58 flanges
60 cut-out
62 edge

The invention claimed is:

1. A drilling assembly for drilling a borehole in a rock body and inserting a rock bolt within the borehole in a single pass, wherein the rock bolt is configured as a combination of both an anchor bolt and a friction bolt, the drilling assembly comprising:

an elongated drill string having a downhole end;

a drill bit arranged to be detachably joined to the downhole end of the drill string, the drill bit having an external screw thread extending in an axial direction of the drill string; and an elongated friction bolt sleeve having an internal axial passage and at least partially surrounding the drill string, wherein the friction bolt sleeve extends substantially along the length of the drill string but is spaced apart from the drill bit during a drilling operation, and wherein the friction bolt sleeve has a thread engaging formation at or near its downhole end arranged to cooperate with the external screw thread of the drill bit.

2. The drilling assembly as claimed in claim 1, wherein the drill bit is detachably joined to the drill string by a spigot and socket connection, whereby the spigot is removably received within the socket.

3. The drilling assembly as claimed in claim 2, wherein the spigot extends from the downhole end of the drill string and is aligned along the drill strings' central axis, and wherein the socket is defined within the drill bit.

4. The drilling assembly as claimed in claim 2, wherein the spigot extends from the drill bit and the socket is defined in the downhole end of the drill string and is aligned along drill strings' central axis.

5. The drilling assembly as claimed in claim 2, wherein the spigot has an outer surface defining one or more grooves extending along the spigot and wherein the socket has an inner surface defining one or more ridges being complementary to the grooves, whereby the ridges are received within the grooves when the drill bit is joined to the drill string.

6. The drilling assembly as claimed in claim 5, wherein the grooves extend spirally around and along the spigot to define a helix, a double helix, a triple helix or a quadruple helix.

7. The drilling assembly as claimed in claim 6, wherein the grooves extend at an angle of 1°-20° relative to the drill strings' central axis.

8. The drilling assembly as claimed in claim 7, wherein the grooves and the external screw thread spiral in the same direction.

9. The drilling assembly as claimed in claim 1, wherein the drill bit is substantially frustoconical having a tapered side wall.

10. The drilling assembly as claimed in claim 9, wherein the drill bit is cylindrical along a part of its length extending from its downhole end to the tapered side wall.

11. The drilling assembly as claimed in claim 9, wherein the external screw thread extends along the length of the tapered side wall.

12. The drilling assembly as claimed in claim 1, wherein the friction bolt sleeve is substantially tubular and has an axial slot extending along its length so that the friction bolt sleeve is substantially C-shaped in end view.

13. The drilling assembly as claimed in claim 1, wherein the thread engaging formation comprises a downhole edge of the friction bolt sleeve.

14. The drilling assembly as claimed in claim 1, wherein the thread engaging formation comprises one or more bent off flanges extending radially inwardly from the friction bolt sleeve.

15. The drilling assembly as claimed in claim 1, wherein the thread engaging formation comprises an internal screw thread integrally formed within the friction bolt sleeve.

16. The drilling assembly as claimed in claim 15, wherein the internal screw thread tapers inwardly from the downhole end of the friction bolt sleeve.

17. The drilling assembly as claimed in claim 16, wherein the internal screw thread tapers at an angle of 1°-10° relative to the friction bolt sleeve's central axis.

18. The drilling assembly as claimed in claim 1, wherein the thread engaging formation comprises an internal screw thread defined within a nut that is fixedly attached within the friction bolt sleeve.

19. A method of drilling a borehole in a rock body and inserting a rock bolt within the borehole in a single pass, wherein the rock bolt is configured as a combination of both an anchor bolt and a friction bolt, the method comprising the steps of:

providing a drill string having a detachable drill bit joined to its downhole end, the drill bit having an external screw thread extending in an axial direction of the drill string;

providing an elongated friction bolt sleeve having an internal axial passage with a thread engaging formation at or near its downhole end, and locating the friction bolt sleeve around the drill string so that the friction bolt sleeve extends substantially along the length of the drill string but is spaced away from the drill bit during a drilling operation;

with the drill string rotating in a first direction, drilling the borehole until the friction bolt sleeve has been inserted into the borehole to a desired length so that the friction bolt sleeve is frictionally engaged and held within the rock body;

while continuing rotation of the drill string in the first direction, withdrawing the drill string from the borehole with the drill bit remaining attached to the drill string so that the drill bit enters into the downhole end of the friction bolt sleeve allowing the external screw thread on the drill bit to engage the thread engaging formation of the friction bolt sleeve, and subsequently screwing the drill bit into the friction bolt sleeve until the drill bit and friction bolt sleeve become wedged against the rock body; and stopping or reversing the direction of rotation of the drill string to permit the drill bit to be detached from the drill string and subsequently fully retracting the drill string from the friction bolt sleeve.

20. The method as claimed in claim 19, which is performed using a drilling assembly comprising:

an elongated drill string having a downhole end;

a drill bit arranged to be detachably joined to the downhole end of the drill string, the drill bit having an external screw thread extending in an axial direction of the drill string; and an elongated friction bolt sleeve having an internal axial passage and at least partially surrounding the drill string, wherein the friction bolt sleeve extends substantially along the length of the drill string but is spaced apart from the drill bit during a drilling operation, and wherein the friction bolt sleeve has a thread engaging formation at or near its downhole end arranged to cooperate with the external screw thread of the drill bit.

21. A drill bit for use in a drilling assembly for drilling a borehole in a rock body and inserting a rock bolt within the borehole in a single pass, the drill bit comprising:

a drill bit body arranged to be detachably joined to the downhole end of a drill string, the drill bit having an external screw thread extending in an axial direction of the drill string, wherein the external screw thread is configured to cooperate with a thread engaging formation provided at or near a downhole end of a friction bolt sleeve so that the drill bit is able to be screwed into the friction bolt sleeve;

wherein the drill bit body is substantially frustoconical having a conically tapered side wall, and wherein the external screw thread extends along the length of the tapered side wall.

22. The drill bit as claimed in claim 21, wherein the drill bit body is cylindrical along a part of its length extending from its downhole end to the tapered side wall.

* * * * *